US008544456B2

(12) United States Patent
Grace

(10) Patent No.: US 8,544,456 B2
(45) Date of Patent: Oct. 1, 2013

(54) ADJUSTABLE DRAW STOP FOR ARCHERY BOWS

(75) Inventor: Nathaniel E. Grace, Port Huron, MI (US)

(73) Assignee: Grace Engineering Corp., Memphis, MI (US)

( * ) Notice: Subject to any disclaimer, the term of this patent is extended or adjusted under 35 U.S.C. 154(b) by 352 days.

(21) Appl. No.: 13/171,033

(22) Filed: Jun. 28, 2011

(65) Prior Publication Data

US 2012/0000451 A1 Jan. 5, 2012

Related U.S. Application Data

(60) Provisional application No. 61/360,716, filed on Jul. 1, 2010.

(51) Int. Cl.
*F41B 5/10* (2006.01)

(52) U.S. Cl.
CPC . *F41B 5/105* (2013.01); *F41B 5/10* (2013.01); *Y10S 124/90* (2013.01)
USPC ..... 124/25.6; 124/23.1; 124/86; 124/900

(58) Field of Classification Search
CPC ..... F41B 5/10; F41B 5/105
USPC ..... 124/23.1, 25.6, 86, 900
See application file for complete search history.

(56) References Cited

U.S. PATENT DOCUMENTS

| | | | | |
|---|---|---|---|---|
| 5,934,265 | A * | 8/1999 | Darlington | 124/25.6 |
| 6,082,346 | A * | 7/2000 | Andrews et al. | 124/25.6 |
| 6,250,293 | B1 * | 6/2001 | Andrews | 124/25.6 |
| RE37,544 | E * | 2/2002 | Darlington | 124/25.6 |
| 6,360,735 | B1 * | 3/2002 | Larson et al. | 124/25.6 |
| 6,516,790 | B1 * | 2/2003 | Darlington | 124/25.6 |
| 6,691,692 | B1 * | 2/2004 | Adkins | 124/25.6 |
| 6,871,643 | B2 * | 3/2005 | Cooper et al. | 124/25.6 |
| 6,990,970 | B1 * | 1/2006 | Darlington | 124/25.6 |
| 6,994,079 | B1 * | 2/2006 | Darlington | 124/25.6 |
| 7,082,937 | B1 * | 8/2006 | Land | 124/25.6 |
| 7,690,372 | B2 * | 4/2010 | Cooper et al. | 124/25.6 |
| 7,770,568 | B1 * | 8/2010 | Yehle | 124/25.6 |
| 8,006,679 | B2 * | 8/2011 | Strother | 124/25.6 |
| 8,276,574 | B1 * | 10/2012 | Wilson | 124/25.6 |
| 8,281,773 | B2 * | 10/2012 | Dahl et al. | 124/25.6 |
| 8,281,774 | B2 * | 10/2012 | Grace | 124/25.6 |
| 8,360,041 | B2 * | 1/2013 | Strother | 124/25.6 |

(Continued)

OTHER PUBLICATIONS

Quest XPB Bow (2008).

*Primary Examiner* — Gene Kim
*Assistant Examiner* — Alexander Niconovich
(74) *Attorney, Agent, or Firm* — Warner Norcross & Judd LLP

(57) ABSTRACT

A draw length adjustment system including a draw stop, an adjustment element and a fastener that joins the draw stop and/or adjustment element with a cam or pulley of an archery bow. The draw length adjustment system is micro-adjustable so that an archer can make minute and/or incremental adjustments to the draw stop, and thus the draw length of the archery bow. The draw stop can be of an eccentric construction that is eccentrically rotatable relative to the cam or pulley to alter the draw length. Alternatively, the draw stop can be selectively moveable relative to the cam assembly via a rack and pinion gear to alter the draw length.

20 Claims, 5 Drawing Sheets

(56) References Cited

U.S. PATENT DOCUMENTS

| | | | | |
|---|---|---|---|---|
| 8,485,169 | B2 * | 7/2013 | Dahl, II | 124/25.6 |
| 2004/0074485 | A1 * | 4/2004 | Cooper et al. | 124/25.6 |
| 2005/0193998 | A1 * | 9/2005 | Cooper et al. | 124/25.6 |
| 2006/0174859 | A1 * | 8/2006 | Andrews | 124/25.6 |
| 2009/0288650 | A1 * | 11/2009 | Batdorf | 124/25.6 |
| 2010/0071677 | A1 * | 3/2010 | Cooper | 124/25.6 |
| 2011/0023857 | A1 * | 2/2011 | Grace | 124/25.6 |
| 2011/0271939 | A1 * | 11/2011 | Strother | 124/25.6 |

* cited by examiner

ADJUSTABLE DRAW STOP FOR ARCHERY BOWS

BACKGROUND OF THE INVENTION

The present invention relates to archery bows, and more particularly to an adjustable draw stop system for use with archery bows.

Conventional compound archery bows include a bowstring and a set of power cables that transfer energy from the limbs and cams or pulleys, both generally referred to as "cams" herein, of the bow to the bowstring, and thus to an arrow shot from the bow. The power cables and bowstring typically are strung from one cam on one limb to another cam on another limb of the bow. The function of the cams is to provide a mechanical advantage so that energy imparted to the arrow is a multiple of that required of an archer to draw the bow.

Most compound bows are outfitted with either single cam systems or dual cam systems, and are configured to accommodate the specific draw length of the archer shooting the bow. As used herein, draw length generally refers to the distance, at full draw, between the nocking point of the arrow on the bowstring to the back of the grip on the bow. Regardless of the cam system, most systems include a construction that enables an archer to modify draw length of the bow so that it is suitable to their physical stature.

In one construction, to adjust the draw length of the bow, the entire cam can be replaced with another cam having different draw length characteristics.

In another construction, the cam can include a replaceable module having a track for either the bowstring or the cable, attached to the cam in a fixed position. This module can be removed from the cam and replaced with another module having different draw length characteristics to adjust the draw length of the bow. Of course, when replacing the module, extra care must be taken to remove and replace the cable or bowstring relative to the track of the module. Moreover, special equipment, such as a bow press, might be required to remove tension from the bowstring and/or cables to replace the module.

Another construction that adjusts draw length includes a "rotating module" that is fastened to a cam. The rotating module defines a track that accommodates a cable or a bowstring. The rotating module is configured to be rotationally indexed in relation to the cam, and subsequently attached in any one of several positions relative to the cam. The various positions provide different draw length characteristics by altering the amount of cable and/or bowstring let out of the module and/or cam.

Still another construction adapted to adjust draw length includes a draw stop mounted on a cam to limit rotation of the cam. The draw stop includes a head from which a threaded post projects. The post is positioned in an elongated, smooth sided slot defined by the cam. The post is secured within the slot at a position corresponding to a location of the head that sets the draw length. The head projects from the side of the cam. When the bow is drawn, the cam rotates, however, the draw stop's path is such that the head of the draw stop engages a limb of the bow to interrupt and stop rotation of the cam. The amount of rotation corresponds to an amount of bowstring and/or cable let out, which in turn corresponds to a specific draw length. Usually, however, these types of draw stops can be prone to moving due to relative sliding of the threaded post in the slot, and can be difficult to finely adjust to set a precise draw length.

While conventional cam systems provide satisfactory performance, they are typically difficult adjust for draw length to accommodate an archer's physical stature. For cam systems that use interchangeable cam modules to adjust draw length, the usual added expense of servicing the bow by an experienced bow technician, or the use of a bow press, can be a deterrent to changing the draw length. Further, most draw stops are be difficult to finely adjust, which can make draw length setting frustrating.

SUMMARY OF THE INVENTION

A draw length adjustment system is provided including a draw stop, an adjustment element and a fastener that joins the draw stop and/or adjustment element with a cam or pulley of an archery bow. The draw length adjustment system is micro-adjustable so that an archer can make minute and/or incremental adjustments to the draw stop and thus the draw length of the archery bow, depending on the archer's personal preferences and/or stature.

In one embodiment, the draw length adjustment system, also referred to herein as an adjustable draw stop assembly, is configured to enable an archer to move the draw stop a preselected amount to set a desired draw length or draw stop.

In another embodiment, the draw length adjustment system includes a fastener that can be tightened and/or loosened relative to an adjustment element. The archer can reposition the draw stop, and retighten the fastener at a desired location relative to the cam to provide a desired draw length or an effective "bottom" of a draw stroke of the bow to which the draw length adjustment system is joined.

In still another embodiment, the draw length adjustment system can include a draw stop body and an adjustment element in the form of a rack and pinion gear. The rack can be defined on a portion of a slot. The pinion gear can be included on the draw stop body and/or a post extending from the draw stop body that fits within the slot. The pinion gear can configured to engage the rack in the slot. The body can be rotated to incrementally and/or selectively move the draw stop body relative to a cam to adjust the draw length of the bow.

In yet another embodiment, the draw length adjustment system can include a draw stop body in the form of an eccentric cam. The draw stop body can define a mounting hole having a mounting hole axis that is offset from a centrally located axis of the body. A fastener can be placed through the mounting hole to fasten the body to the cam of a bow. The body can be selectively and eccentrically rotatable about the mounting hole axis to move the draw stop relative to the cam so that preselected portions of the draw stop body can engage a structure of the bow, for example, a limb, to adjust the draw length of the bow.

In even another embodiment, graduation indicia or markings can be provided in relation to the draw length adjustment system to provide more precise and repeatable adjustments.

In a further embodiment, the draw length adjustment system can include components that suppress noise or vibration that may occur when the draw stop contacts a limb or cable of an archery bow to which the draw length adjustment system is joined.

In still a further embodiment, the draw length adjustment system can reduce the potential for an archer to overdraw the bow, which typically results in a dangerous situation for the archer. For example, the cam system could effectively lock up, even when the archer releases the bowstring of the bow. With such a situation, the archer would then be faced with the dilemma of how to get the cam system to unlock, and yet do so without the cam system engaging under the energy stored in the limbs of the bow and rapidly moving the bowstring.

These and other objects, advantages, and features of the invention will be more fully understood and appreciated by reference to the description of the current embodiment and the drawings.

DETAILED DESCRIPTION OF THE CURRENT EMBODIMENTS

Figure 1:
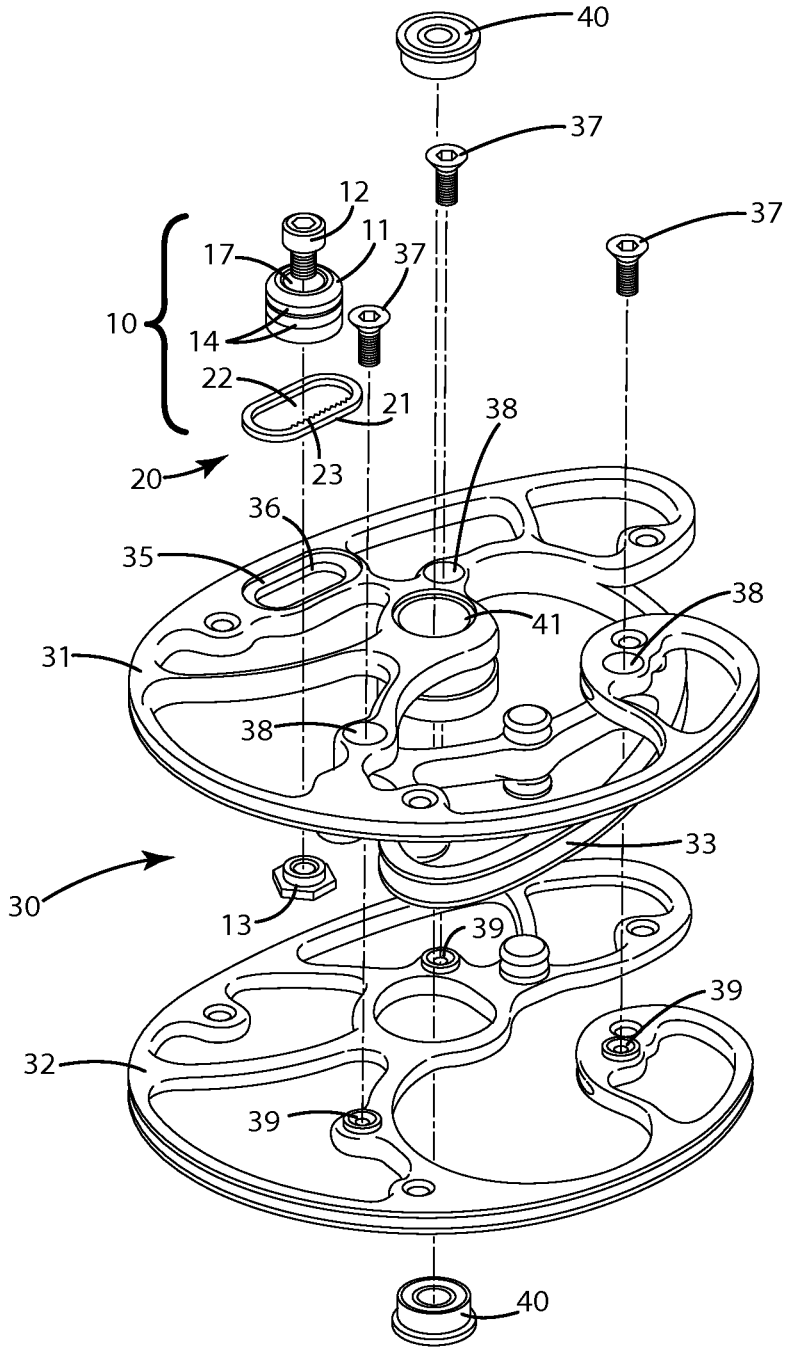
FIG. 1 is an exploded view of a compound bow cam assembly including a an adjustable draw stop assembly.
Figure 2:
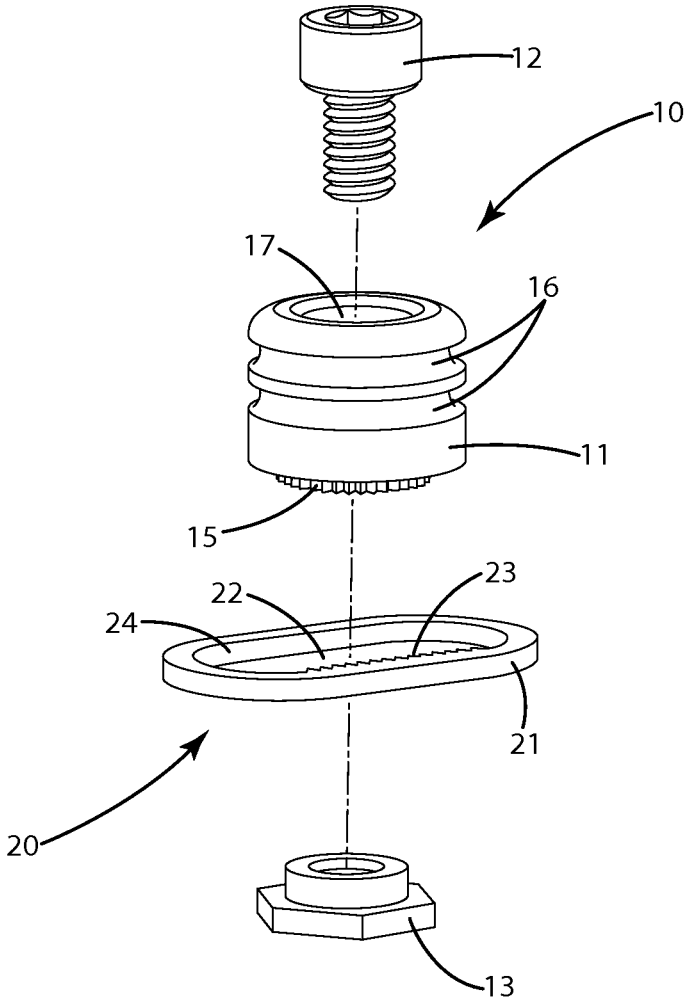
FIG. 2 is an enlarged exploded view of the adjustable draw stop assembly.

A draw length adjustment system, also referred to as an adjustable draw stop assembly, is shown in FIGS. 1 and 2 and generally designated 10. The adjustable draw stop assembly 10 can be joined with a cam assembly 30 of an archery bow, and in particular, a compound archery bow.

Although illustrated in connection with a particular cam assembly having dual bowstring tracks, the embodiments of the adjustable draw stop assembly are well suited for other types of cams of single cam compound archery bows, dual cam bows, cam and a half bows, crossbows and other archery systems including a cam and/or a pulley. Further, as used herein, a "cam" refers to a cam, a pulley, and/or an eccentric, whether a modular, removable part, or an integral part of a cam assembly, for use with an archery bow.

In addition, as used herein, "inhibit" refers to stopping, preventing, impairing and/or reducing a certain event, action, result, force, torque, twist and/or activity. As used herein, a "track" refers to a structural element that is adapted to guide or accommodate a portion of a bowstring or power cable of a bow within or adjacent the element, and can be in the form of a groove, a recess, a slot, pins or posts extending from or defined by a surface or element. When in the form of a groove or recess, that element can be defined by a part of a cam assembly, and can be of virtually any geometric cross section, for example, partially or fully semi-circular, rounded, triangular, rectangular, square, polygonal, or combinations of the foregoing.

The draw stop assembly 10 can include a draw stop body 11, a mounting element or fastener 12 and adjustment elements, which as illustrated in FIGS. 1 and 2, include a rack 23 that engages a pinion gear 15 associated with the draw stop body 11. As shown, the fastener 12 can be a bolt, screw, pin, boss, rivet, or other fastener. Optionally, the fastener 12 can engage a nut 13 to join the draw stop assembly 10 with the cam assembly 30. Alternatively, the cam assembly 30 can define a threaded hole (not shown) into which the fastener is threaded.

The draw stop body 11 can take a variety of geometric shapes, but as shown is generally cylindrical, and includes a first end and a second end. The draw stop body 11 can include a co-axial pinion gear 15 at its second end and a co-axial through bore 17 through which the fastener 12 can be at least partially inserted. The pinion gear 15 can be formed on the second end or lower surface of the body, and can be annular in shape with peripheral gear teeth and an axis coincident with that of the mounting bore 17. Of course, the pinion gear alternatively can be a smooth, knurled or an otherwise roughened surface that can engage a portion of the insert 20 or other portion of the cam assembly 30 and enable the elements to move relative to one another when the draw stop body 11 is rotated or moved and/or when the insert is moved.

Optionally, the draw stop body 11 can define at least one annular recess 16 for retention of an optional shock and/or sound absorption ring 14 of a resilient material, for example, an O-ring. The draw stop body can be machined or otherwise formed from metal, optionally aluminum, or molded from a suitable composite material.

The insert 20 can define a rack 23 which meshes with the pinion gear 15 of the draw stop body 11, providing controlled linear and/or curvilinear movement of the draw stop body 11 upon rotation of the body or gear by an archer. The rack 23 can be located along a generally straight segment of the inner wall or perimeter 24 of the insert 20 defined by the elongated bore 22, which generally can be of an oblong configuration. Optionally, the rack 23 can be provided on the opposing straight segment of the inner wall or perimeter as well.

If desired, the bore and/or rack can be curvilinear, or partially curvilinear and partially linear, in shape to provide an arced or combination linear and curvilinear path of movement for the draw stop body. The rack 23 can be provided on at least one of the longer sides of the opening 22, and can include gear teeth designed to mesh with corresponding gear teeth on the pinion 15 of the draw stop portion 11. Of course, the rack alternatively can be a smooth, knurled or an otherwise roughened surface that can engage a portion of the draw stop body 11 so that the elements move relative to one another when the draw stop body is rotated and/or the insert is moved. The rack 23 can be molded from a composite material or hard plastic such as, but not limited to, Delrin®. Alternatively, the rack can be manufactured from metal, optionally aluminum, machined to the required shape, or formed by die casting or metal injection molding.

The insert 20 can be positioned at least partially within a recess 35 defined in the cam assembly 30. The recess 35 can correspond in shape or include fasteners to capture to the periphery 21 of the insert portion 20. The insert 20 can be joined with the cam portion 31 by a press fit or, optionally, with fasteners or an adhesive such as an epoxy, glue or cement. Alternatively, the insert can be deleted entirely, with the rack 23 defined by a simple recess or hole defined by the cam portion 31, or some other portion of the cam assembly 30. In such a construction, the rack can be machined into the surface or portions of the cam assembly 30.

As best seen in FIG. 2, the pinion gear 15 on the draw stop body 11 can be registered in the opening 22 of the insert 20 and can mesh with the corresponding teeth of the rack 23. The rack or teeth can be defined in a perimeter 24 of the opening 22 along one or more sides of the opening, depending on the application. A nut 13 can engage the fastener 12 and can be trapped in a recess 36 on the underside of upper member 31 of the cam assembly 30. After the draw stop body 11 is positioned in a desired location relative to the cam assembly 30 to accommodate a particular draw length and/or draw stop position, it can be secured by tightening the fastener 12 and any corresponding nut 13. Indicator markings (not shown) can be provided on the surface of the cam member 31 to allow the archer to calibrate the location of the draw stop and precisely place the draw stop body, optionally in a previously selected stop location.

As shown in FIG. 1, the components of the illustrated cam assembly 30 of the first embodiment can be secured with fasteners, shown as screws, 37 that are inserted in through holes 38 in upper member 31. The screws can engage mating threaded holes 39 in the lower member 32. A cable module 33 can be sandwiched and secured between the upper 31 and lower 32 members. Optionally, where there is only a single cam member 31 for a particular cam assembly, the cable module 33 can simply be attached to that member. Bushings, or optional bearing assemblies, 40 for the cam assembly axle (not shown) can be included in the assembly.

The adjustable draw stop assembly 10 shown in FIGS. 1 and 2 can be adjusted to provide a different draw length or draw stop for the associated archery bow quickly and efficiently. Specifically, the draw stop body 11 can be moved so that it engages a bow limb or other component of an archery bow (not shown) as desired, thereby restricting rotation of the cam assembly 30, and subsequently defining the draw length or draw stop location of the archery bow. Adjustment of the draw stop assembly 10 can be performed by loosening the fastener 13 and rotating the draw stop body 11. In turn, this rotates the pinion gear 15, enabling it to engage and move precisely along or relative to the rack 23. Generally, the movement of the pinion gear 15 relative to the rack gear 23 can move the draw stop body 11 relative to the cam assembly 30. This movement of the draw stop body 11 relative to the cam assembly changes the degree of rotation of the cam assembly. With such movement, the draw length of the bow changes from a first draw length to a second draw length. Where the rack and pinion gears are diminutive in size, the archer can very finely adjust or move the draw stop body relative to the cam assembly, and thereby adjust the draw length of the related bow in small increments and to a high degree of precision.

When the desired position of the draw stop body 11 relative to the cam assembly 30 and/or the associated bow limb or other archery component is achieved, the archer ceases rotation of the pinion gear 15 and subsequent movement of the draw stop body 11 relative to the rack 23 and cam assembly 30. The fastener 12 can be re-tightened to retain the draw stop body 11 in the location attained via the adjustment by the archer. With the draw stop in this desired location, the draw stop assembly 10 is positioned to selectively engage a bow limb or other components of the bow, thereby inhibiting further rotation of the cam assembly 30 upon such engagement.

In such a configuration, the draw stop assembly provides a specific degree of rotation of the cam assembly, a corresponding pay out of the bowstring, and a resultant draw length, as described in more detail in the embodiment below. Again, if desired, corresponding reference marks can be provided on the rack insert and the perimeter of the draw stop body for precise settings, and to provide a frame of reference for the archer to calibrate the draw stop and/or precisely adjust the draw stop assembly to certain positions corresponding to certain draw lengths for particular applications as desired.

First Alternative Embodiment

A first alternative embodiment of the draw length adjustment system, also referred to as a draw stop adjustment assembly, is illustrated in FIGS. 3-6 and generally designated 110. The draw stop assembly 110 can include a draw stop body 111, a mounting element or fastener 112 and adjustment elements, which as illustrated, can include a mounting hole 119 that receives a mounting fastener 112, where the mounting axis, also referred to as a mounting hole axis 160 in this embodiment, which is offset from the geometric or central axis 150 of the draw stop body 111 to provide the draw stop body 111 with eccentricity, and thereby produce a cam effect on the periphery of the draw stop body 111 as it is rotated about its mounting hole axis 160. Generally, a draw stop body 111 including such an offset mounting hole is referenced to herein as an eccentric draw stop body. The eccentricity of the draw stop assembly 111 can provide an archer with the ability to selectively alter the draw length or draw stop location by establishing a desired orientation of the draw stop body 111 relative to the cam assembly 130. This desired orientation can be varied by rotating the draw stop body 111 about the offset mounting hole axis 160 as described further below.

The draw stop body 111 can be adjustably secured to the cam assembly 130 by placing the mounting element 112 at least partially through the mounting hole 119 and engaging the mounting element 112 with a corresponding cam hole 113, optionally threaded, defined in the cam member 131, or a nut or other fastener associated with the cam assembly. The draw stop body mounting hole 119 can include a mounting hole axis 160 that is offset from the axis 150 of the draw stop cylindrical body 111. When assembled, this mounting hole axis 160 can be aligned with the axis of the cam hole 113.

Optionally, although the fastener is shown as a threaded member, it can be substituted with a pin or post projecting from the face of the cam member 131 along a mounting axis offset from the central axis. This post can be placed in the mounting hole and the two components secured together with a set screw or other fastener that engages the post. Further optionally, the illustrated threaded fastener can be substituted with a pin or post projecting from the draw stop body along a mounting axis offset from the central axis. This post can be configured to be inserted in a corresponding hole or other feature defined by the cam assembly and held in place via a nut, set screw, or other fastener or mechanism engaging the post or draw stop body. Even further optionally, the body 111 of the draw stop 110 can define at least one recess 116 for retention of a corresponding number of resilient shock absorbing and sound suppression members 114, also referred to as bumpers herein.

Figure 3:
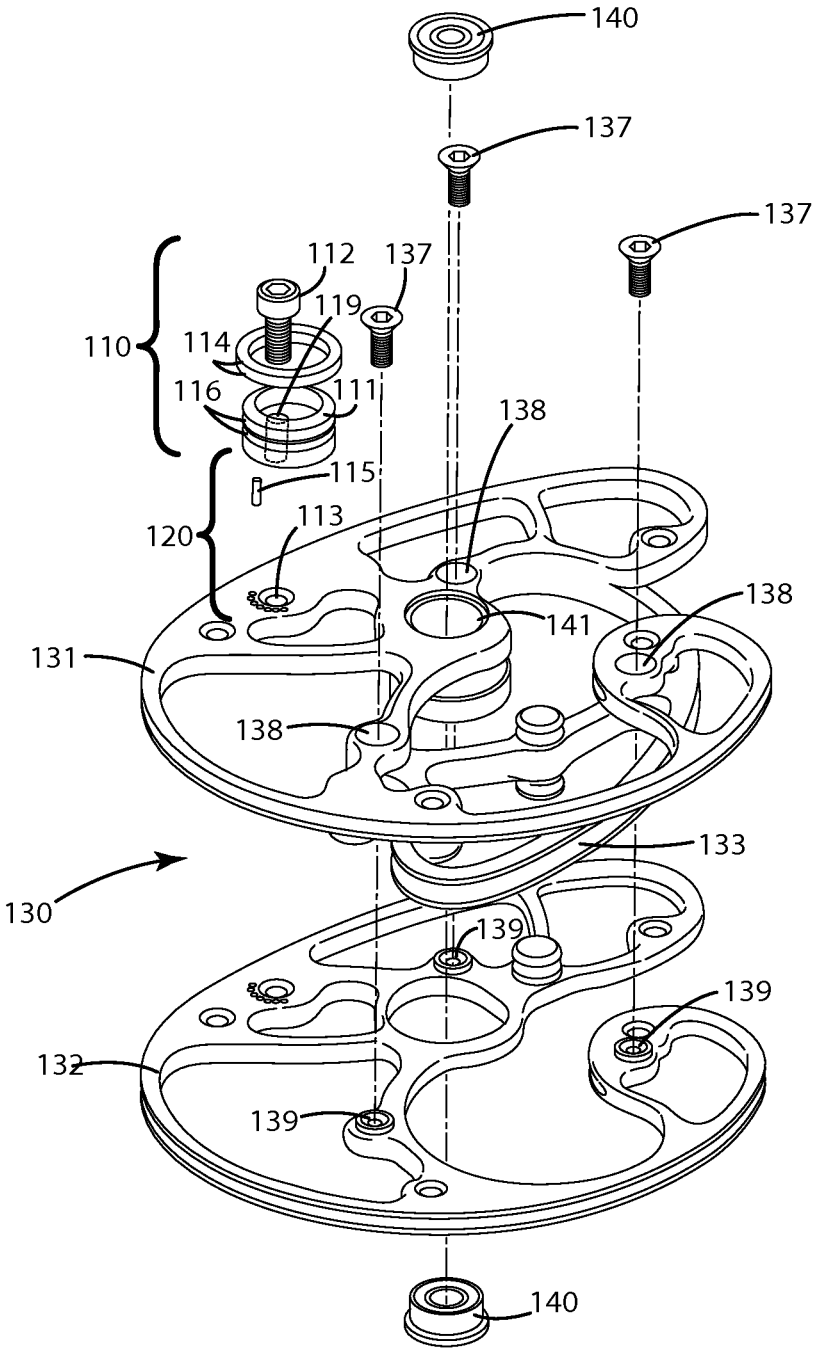
FIG. 3 is an exploded view of a cam assembly including a first alternative embodiment of the adjustable draw stop assembly.
Figure 4:
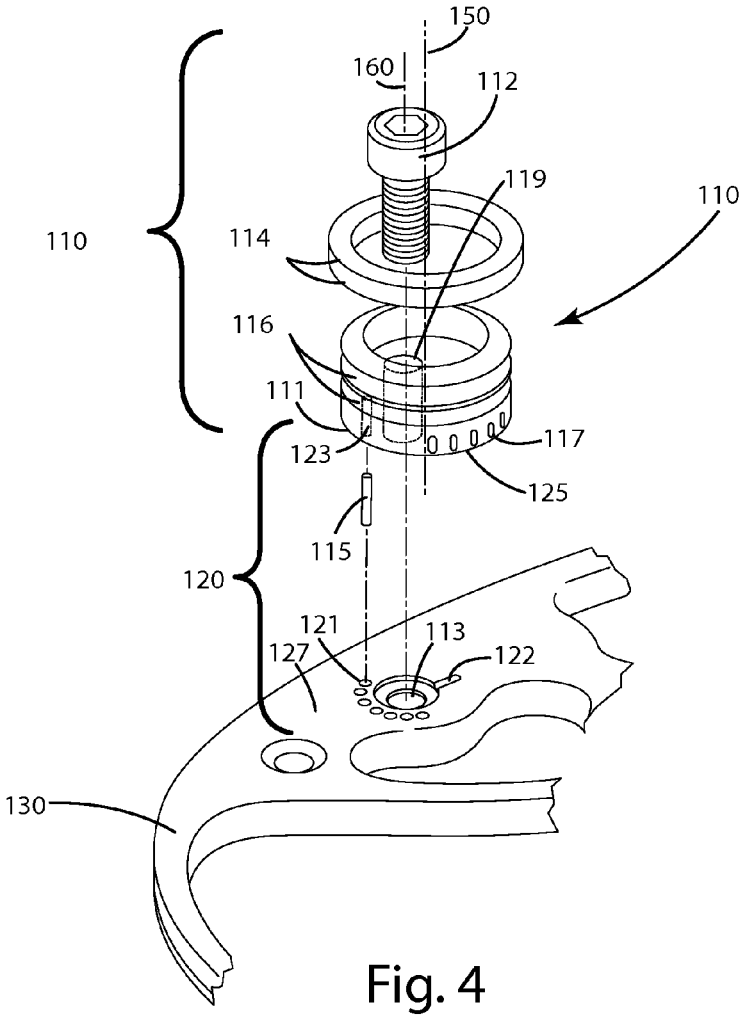
FIG. 4 is an enlarged exploded view of the first alternative embodiment of the adjustable draw stop assembly.

The adjustable draw stop assembly 110 can include one or more alignment elements 120 which align the draw stop body in a preselected orientation relative to the cam assembly 130. In such a preselected orientation, the draw stop body 111 can be configured so it is substantially non-rotatable relative to the cam assembly, or in a fixed rotational orientation relative to the cam assembly. As shown in FIGS. 3-4, the alignment elements can include the alignment elements can include a locating pin 115 and one or more holes 121, 123 defined in the respective draw stop body 111 and cam assembly surface 127. The locating pin 115 can be configured to register in one of multiple holes 121 defined by the cam surface 127 on the cam 131 adjacent the draw stop body 111. The locating pin 115 can register in a corresponding hole 123 defined by the bottom or lower surface 125 of the draw stop body 111. Optionally, a cylindrical or other geometrically shaped boss can be used in lieu of the pin 115, where the boss is integral with and projects from one or both of the draw stop body 111 and/or the cam 131, and registers in a correspondingly shaped and sized hole defined by the other of the components.

As more readily seen in FIG. 4, an array of holes 121 can be defined along certain radii distanced from the axis 160 of the mounting hole 113 in the surface 120 of the upper cam member 131. The radii can be located along a semi-circle or other geometric shape that corresponds to the radial location of the locating pin or boss on the draw stop body 111 from the axis of the cam hole 113. The locating pin 115 can engage any one of the holes 121 when the draw stop body 111 is eccentrically rotated about the offset axis 160, thereby defining variable draw stop positions as the peripheral surface of the draw stop body 11 engages a bow limb or other component of the archery bow to which the cam assembly is joined.

Optionally, reference indicia 122 can be provided on the surface of the cam member 131 to correspond to indicia 117 on the periphery of the draw stop body 111 to enable the archer to accurately and reproducibly position the draw stop body 111 relative to the cam assembly, and to return precisely to previously selected settings for draw length.

The cam assembly 130 for the alternative embodiment generally can be the same as that of the first embodiment, except for the manner of attachment and function of the respective draw stop assemblies 10 and 110 as previously described.

The adjustable draw stop assembly 110 shown in FIGS. 3 and 4 can be adjusted to provide a different draw length or draw stop for the associated archery bow quickly and efficiently. Specifically, the draw stop body 111 can be moved so that it engages a bow limb 200 (FIGS. 5-6) or other component of an archery bow as desired, thereby restricting rotation of the cam assembly 130, and subsequently defining the draw length or draw stop location of the archery bow 208 to which the cam assembly is attached.

Adjustment of the draw stop assembly 110 can be performed by loosening the fastener 112 sufficiently so that the body 111 can move. The body 111 can be lifted away from the cam surface 120 to disengage the alignment elements. For example, the locating pin 115 or boss can be removed from a first one of the locating holes 121 and moved to another of the locating holes 121, while remaining in the same hole 123 of the draw stop body 111. The body 111 can be eccentrically rotated about the offset mounting axis 160 of the assembly 110 and the locating pin registered in another of the holes 121 defined by the cam assembly 130. When the locating pin is properly registered, and thus the draw stop body 111 is located in a desired orientation relative to the cam assembly 130 and/or the associated bow limb or other archery component, the body 111 can be moved back toward the cam, and the fastener 112 can be refastened to secure the body 111 in a new fixed rotational orientation relative to the cam assembly 130. This new fixed rotational orientation relative to the cam assembly 130 can be different from the previous fixed rotational orientation, which accordingly can alter the amount of rotation of the cam assembly, and thereby alter the draw length or draw stop of the archery bow.

Figure 5:
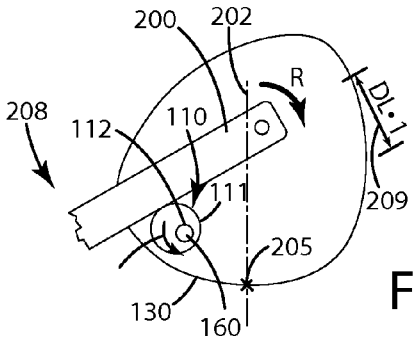
FIG. 5 is a side view of the first alternative embodiment of the adjustable draw stop assembly oriented to provide a first draw length.
Figure 6:
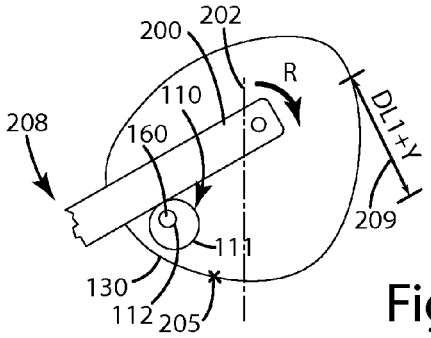
FIG. 6 is a side view of the first alternative embodiment of the adjustable draw stop assembly oriented to provide a second draw length.
Figure 7:
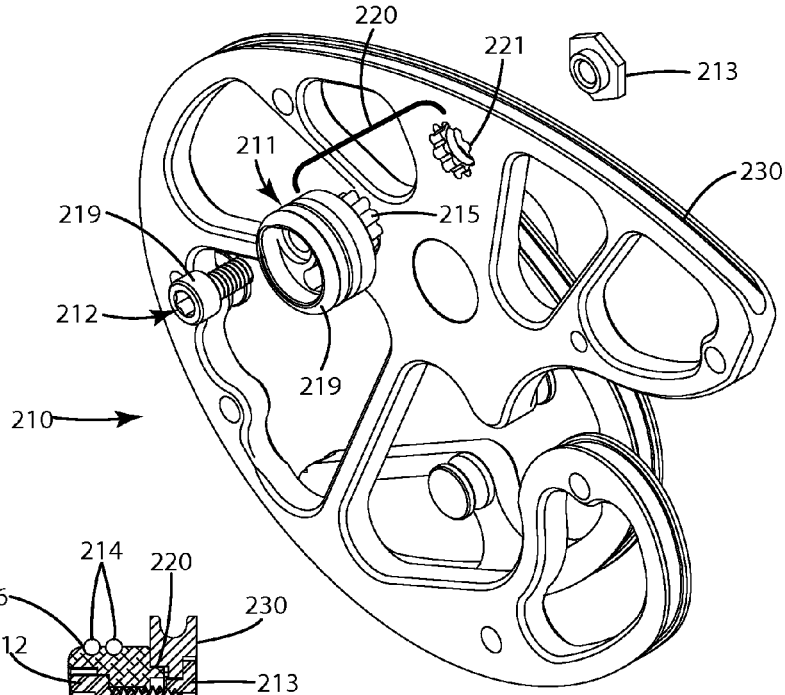
FIG. 7 is a perspective view of a second alternative embodiment of the adjustable draw stop assembly.

FIGS. 5 and 6 illustrate an example of adjusting the adjustable draw stop assembly 110 to increase draw length of the bow. In this example, the eccentric draw stop body 111 in FIG. 5 impairs rotation of the cam assembly 130 when it engages the limb 200. In this configuration, the maximum rotation of the cam assembly 130 aligns the exemplary reference point 205 with a reference line 202 as illustrated. This amount of rotation corresponds to a certain payout of the bowstring 209, which corresponds to a first draw length DL1.

To adjust the draw stop assembly 110 and provide a second, different (for example, greater) draw length, the archer eccentrically rotates the draw stop body 111 of the draw stop assembly 110 as describe above, while the bow is in an undrawn state, and optionally without the use of a bow press or other device that takes the tension out of the bowstring. Specifically, the archer rotates the assembly 110 in the direction of arrow 207 in FIG. 5, and then tightens the fastener 112 to secure and fix the body 111 in a second fixed rotational orientation relative to the cam assembly 130 as shown in FIG. 6.

When compared to the orientation in FIG. 5, the draw stop assembly 110 in the new orientation shown in FIG. 6 now enables the cam assembly 130 to rotate a greater amount in direction of the arrow R when the bow is drawn before the draw stop assembly 110 engages the limb 200. This extra rotation is illustrated by the exemplary reference point 205 being forward of the reference line 202 in FIG. 6. This extra rotation also translates to more bowstring 209 being paid out from the cam assembly 130, which in turn, corresponds to the draw length being lengthened to DL1+X, which is greater than DL1 by a preselected distance X. Optionally, the adjustable draw stop assembly 110 can be adjusted in a similar manner to shorten or otherwise change the draw length or draw stop location.

If desired, the adjustable draw stop assembly 10 of the embodiment above can be adjusted as described in connection with the operation of that embodiment to yield similar alterations in draw length.

Second Alternative Embodiment

A second alternative embodiment of the draw length adjustment system, also referred to as a draw stop adjustment assembly, as illustrated in FIGS. 7-10 and generally designated 210. This embodiment is similar in structure and operation to the above noted embodiments with several exceptions. For example, the draw stop assembly 210 can include a draw stop body 211 and a mounting element or fastener 212. Like the first alternative embodiment above, the mounting axis, shown as a mounting hole axis 260 can be offset from the geometric or central axis 250 (FIG. 10) of the draw stop body 211. In turn, this can provide the draw stop body with certain eccentricity in which case the draw stop body can be an eccentric draw stop body which produces a cam effect on the periphery 218 of the draw stop body 211 as it is rotated about its mounting hole axis 260.

Optionally, the draw stop body 211 an define recesses or indentations 216 that accommodate bumpers 214 as with the first alternative embodiment above. The draw stop body 211 can also define a recess or hole 219 on its outer most surface opposite the cam assembly 230. This recess 219 can be of a depth sufficient to accommodate the head 219 of the fastener 212, and optionally at least partially or wholly conceal the head 219 from view when the draw stop adjustment assembly 210 is viewed from the front view of the bow. Further, if desired, the draw stop body can include indicia 217 to assist an archer in consistently and reproducingly posting the draw stop body to set a desired draw length.

Figure 8:
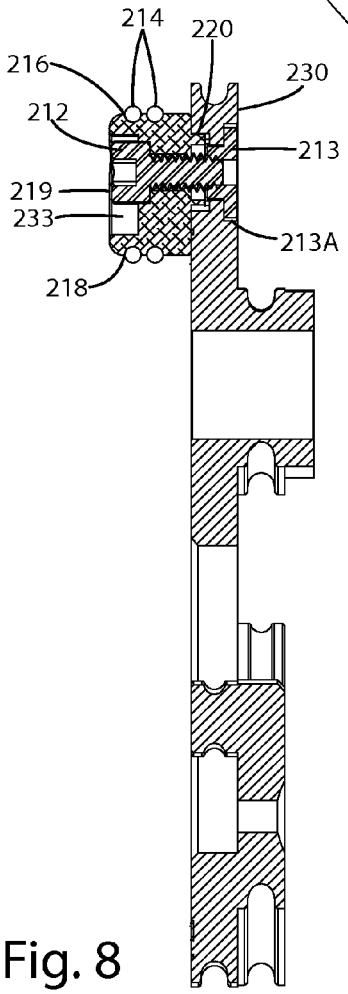
FIG. 8 is a section view of the second alternative embodiment of the adjustable draw stop assembly taken along line 8-8 of FIG. 7.
Figure 9:
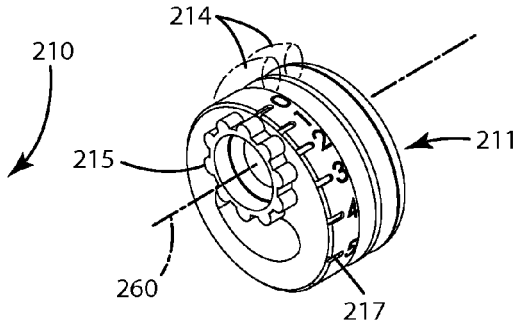
FIG. 9 is a perspective view of an eccentric draw stop body of the second alternative embodiment of the adjustable draw stop assembly.
Figure 10:
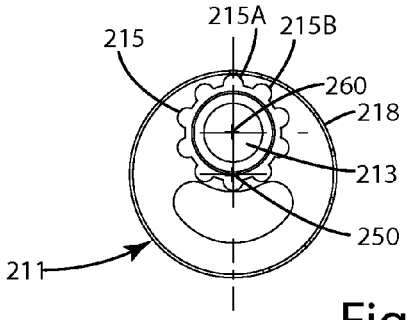
FIG. 10 is a side view of the eccentric draw stop body of the second alternative embodiment of the adjustable draw stop assembly.

The fastener 212 can be adapted to be fastened to a threaded hole in the cam assembly 230, or as shown in FIG. 8 threadedly received by a nut 213. The nut 213 optionally can be received in a correspondingly shaped and sized recess or hole 213A defined by the cam assembly 230. This corresponding interfitting of the nut 213 in the nut recess 213A can inhibit rotation of the nut 213 while the fastener 212 is threaded into it to secure the body 211 to the cam assembly 230 and secure it in a fixed rotational orientation relative to the cam assembly 230. Further optionally, the fastener and nut components of this embodiment can be substituted with the various pin and post components described in the embodiments above.

The draw stop body 211 of this second alternative embodiment can include one or more alignment elements 220 which align the draw stop body in a preselected orientation relative to the cam assembly 230. In such a preselected orientation, the draw stop body 211 can be configured so it is substantially non-rotatable relative to the cam assembly, or in a fixed rotational orientation relative to the cam assembly. As shown in FIGS. 3-4, the alignment elements can include a spline 215 and a corresponding spline receiving hole or recess 221. The spline can include one or more teeth 215*a*, 215*b* which are radially oriented around the draw stop body mounting hole 213 or more generally the mounting axis. The teeth are shown as being lobed and symmetrically and radially orientated about the axis 260, however, the spline can be of virtually any geometric shape or configuration. For example, the outer perimeter of the spline 215 can be a triangular, rectangular, square, hexagonal, pentagonal, polygonal, lobed or irregular geometric shape. The spline recess 221 defined by the cam assembly or other component can likewise be correspondingly shaped so that the engagement of these different components of the alignment feature 220 hold the draw stop body 211 in a fixed rotational orientation relative to the cam when they are engaged with one another.

Optionally, although shown with the spline 215 projecting from the draw stop body 211 and the spline recess 221 being defined by the cam assembly, these features can be reversed in whole or in part. For example, a spline recess can be defined by the draw stop body 211 and a spline can be defined by the cam assembly 230. Further optionally, the fastener and nut components of this embodiment can be substituted with the various pin and post components described in the embodiments above.

The operation, installation and adjustment of this draw stop adjustment assembly is similar to that of the first alternative embodiment above and therefore will not be re-described here.

The above descriptions are those of the preferred embodiments of the invention. Various alterations and changes can be made without departing from the spirit and broader aspects of the invention as defined in the appended claims, which are to be interpreted in accordance with the principles of patent law including the doctrine of equivalents. Any references to claim elements in the singular, for example, using the articles "a," "an," "the," or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

The embodiments of the invention in which an exclusive property or privilege is claimed are defined as follows:

1. An adjustable draw stop assembly for an archery bow that includes a cam assembly, the adjustable draw stop assembly comprising:

a draw stop body;

a pinion gear joined with the draw stop body;

a rack gear joined with a cam assembly of the archery bow, the pinion gear rotatably registered with the rack assembly;

a fastener joining the draw stop body with the cam assembly;

wherein rotation of the pinion gear moves the pinion gear relative to the rack gear so that the draw stop body joined with the pinion gear moves relative to the cam assembly, wherein movement of the draw stop body relative to the cam assembly selectively adjusts a draw length of the bow to which the adjustable draw stop assembly is joined from a first draw length to a second draw length.

2. The adjustable draw stop of claim 1 wherein the fastener is separately and independently formed from the draw stop body, wherein the draw stop body defines a centrally located hole, wherein the fastener is placed at least partially through the centrally located hole.

3. The adjustable draw stop of claim 1 comprising a nut, wherein the nut is threadably received on the fastener to secure the draw stop body in a fixed location relative to the cam assembly of the archery bow.

4. The adjustable draw stop of claim 1 comprising an insert, the insert being joined with the cam assembly, wherein the rack gear is defined by the insert.

5. The adjustable draw stop of claim 4 wherein the cam assembly defines an opening, wherein the insert is located at least partially in the opening of the cam assembly, wherein the insert is fixedly secured at least partially in the opening.

6. The adjustable draw stop of claim 1 wherein the cam assembly defines an opening, wherein the opening includes a perimeter, wherein the rack gear is defined at least a portion of the perimeter.

7. An adjustable draw stop assembly for an archery bow that includes a cam assembly, the adjustable draw stop assembly comprising:

a draw stop body defining a central axis, the draw stop body defining a mounting axis, the mounting axis being offset a preselected distance from the central axis of the draw stop body;

at least one alignment element joined with the draw stop body, the at least one alignment element adapted to engage and selectively inhibit rotation of the draw stop body relative to the cam assembly when the draw stop body is joined with to the cam assembly;

wherein the draw stop body is eccentrically rotatable about the mounting axis, wherein eccentric rotation of the draw stop body about the mounting axis adjusts a draw length of the bow to which the adjustable draw stop assembly is joined from a first draw length to a different, second draw length.

8. An adjustable draw stop assembly for an archery bow that includes a cam assembly, the adjustable draw stop assembly comprising:

a draw stop body defining a central axis, the draw stop body defining a mounting hole having a mounting hole axis, the mounting hole axis being offset a preselected distance from the central axis of the draw stop body;

a fastener joined with the draw stop body and configured to join the draw stop body to a cam assembly; and at least one alignment element joined with at least one of the draw stop body and the fastener, the at least one alignment element adapted to selectively inhibit rotation of the draw stop body relative to the cam assembly when the fastener joins the draw stop body to the cam assembly, wherein the draw stop body is eccentrically rotatable about the mounting hole axis, wherein eccentric rotation of the draw stop body about the mounting hole axis adjusts a draw length of the bow to which the adjustable draw stop assembly is joined from a first draw length to a second draw length.

9. The adjustable draw stop assembly of claim 8 wherein the at least one alignment element includes an array of adjustment holes defined by at least one of the cam assembly and the draw stop body, wherein the at least one alignment element includes at least one of a pin and a boss adapted to be register in one of the adjustment holes to position the draw stop body in a fixed rotational orientation relative to the mounting hole axis.

10. The adjustable draw stop of claim 8 wherein the at least one alignment element includes a spline that is concentric with the mounting hole axis.

11. The adjustable draw stop of claim 10 wherein the spline projects from the draw stop body, wherein the at least one alignment element includes a corresponding spline recess defined by the cam assembly, wherein the spline is adapted to be received within the corresponding spline recess to inhibit rotation of the draw stop body relative to the cam assembly.

12. The adjustable draw stop of claim 8 wherein the at least one alignment element includes a first hole defined by an inner surface of the draw stop body, a second hole defined by an outer surface of the cam assembly, and a pin selectively positioned in the first hole and the second hole to inhibit rotation of the draw stop body relative to the cam assembly.

13. The adjustable draw stop of claim 8 wherein the fastener is positioned through the mounting hole axis, wherein the fastener includes a head, wherein the draw stop body includes a head recess, wherein the fastener head is positioned in the head recess to at least partially conceal the fastener head.

14. The adjustable draw stop of claim 8 comprising at least one of a nut and a threaded hole defined by the cam assembly, the fastener threadably joined with the at least one of a nut and a threaded hole.

15. The adjustable draw stop of claim 8 wherein the draw stop body is void of any tracks adapted to guide a bowstring or a power cable of the archery bow.

16. An archery bow comprising:

a first limb and a second limb spaced from the first limb;

a bowstring adapted to be drawn to a draw length;

a cam assembly rotatably mounted to the first limb, the cam assembly defining at least one of bowstring track and a power cable track; and a draw stop assembly adjustably mounted to the cam assembly, the draw stop assembly including a draw stop body;

wherein the draw stop body is at least one of eccentrically rotatable relative to the cam assembly to alter the draw length, and selectively moveable relative to the cam assembly via a rack and pinion gear to alter the draw length.

17. The archery bow of claim 16 wherein the draw stop body is eccentrically rotatable relative to the cam assembly to alter the draw length, wherein the draw stop body defines a mounting hole having a mounting hole axis, the mounting hole axis being offset a preselected distance from a central axis of the draw stop body, wherein a fastener is positioned through the mounting hole to secure the draw stop body to the cam assembly.

18. The archery bow of claim 16 wherein the draw stop body is selectively moveable relative to the cam assembly via a rack and pinion gear to alter the draw length, wherein the pinion gear is joined with the draw stop body, wherein the cam assembly defines an opening, wherein the rack is located at least partially within the opening.

19. The archery bow of claim 18 comprising an insert, wherein the insert forms the rack, wherein the insert is located at least partially within the opening.

20. The archery bow of claim 18 wherein the opening forms a perimeter, wherein the rack is formed within at least a portion of the perimeter of the opening.

* * * * *